US008328959B2

(12) United States Patent
Engelhardt et al.

(10) Patent No.: US 8,328,959 B2
(45) Date of Patent: Dec. 11, 2012

(54) LEVER-TYPE CAM FOLLOWER

(75) Inventors: Helmut Engelhardt, Herzogenaurach (DE); Ernst Ammon, Hersbruck (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 990 days.

(21) Appl. No.: 11/143,254

(22) Filed: Jun. 2, 2005

(65) Prior Publication Data

US 2005/0274437 A1 Dec. 15, 2005

(30) Foreign Application Priority Data

Jun. 12, 2004 (DE) ..... 10 2004 028 667

(51) Int. Cl.
*C22C 38/44* (2006.01)
*C22C 38/42* (2006.01)

(52) U.S. Cl. ..... 148/335; 148/328; 148/904

(58) Field of Classification Search .... 123/90.39–90.46; 148/225–236, 327, 570–573, 329, 316–320, 148/332–336, 328, 650, 904
See application file for complete search history.

(56) References Cited

U.S. PATENT DOCUMENTS 5,819,694 A * 10/1998 Trutescu et al. ..... 123/90.43
6,413,328 B2 * 7/2002 Takayama et al. ..... 148/319
6,598,571 B1 * 7/2003 Harimoto et al. ..... 123/90.44

OTHER PUBLICATIONS

Computer-generated English translation of Japanese patent 2004263584, dated Sep. 24, 2004.*

* cited by examiner

*Primary Examiner* — Deborah Yee
(74) *Attorney, Agent, or Firm* — Volpe and Koenig, P.C.

(57) ABSTRACT

The invention proposes a lever-type cam follower (1) made without chip removal out of a sheet steel for use in a valve train of an internal combustion engine for actuating at least one gas exchange valve. This lever-type cam follower (1) is characterized by being made of a cold-forming, core-hardening heat-treatable steel.

1 Claim, 2 Drawing Sheets

LEVER-TYPE CAM FOLLOWER

FIELD OF THE INVENTION

The invention concerns a lever-type cam follower made without chip removal out of a sheet steel for use in a valve train of an internal combustion engine for actuating at least one gas exchange valve.

BACKGROUND OF THE INVENTION

An internal combustion engine of an automotive vehicle comprises a valve train mechanism for actuating inlet and outlet valves synchronously to the engine rotation. The valve train mechanism generally comprises a camshaft and a cam tappet that converts the rotary motion of the camshaft into a reciprocating motion for axially operating the inlet and outlet valves. The cam tappet comprises a rocker arm that is driven by cams carried by the camshaft. With the progress of automotive vehicle technology in the field of high-performance engines, there is an increasing demand for compact and light-weight engines with a long operating life and a maintenance-free construction.

It is common knowledge in this connection that such lever-type cam followers made without chip removal from sheet steel are generally made of a case-hardening material such as, for example, 16 Mn Cr 5. Case hardening consists of carburizing or carbonitriding followed by hardening either immediately thereafter or after intermediate cooling and re-heating to an adequate hardening temperature. Depending on the required service properties or the requirements for subsequent working, hardening is followed by tempering or by sub-zero cooling and tempering. Case hardening serves to impart a substantially higher hardness to the surface layer of work-pieces made of steel and better mechanical properties to the work-pieces. For this purpose, the surface layer is enriched prior to hardening with carbon (carburizing) or with carbon and nitrogen (carbonitriding). In contrast to carburizing, the additional enrichment with nitrogen, because it modifies the transformation behavior in the surface layer, leads to a higher hardenability and, after hardening, to a higher tempering stability.

A drawback of lever-type cam followers made in this way is that the heat treatment of the case hardening material is very time-consuming and expensive.

OBJECTS OF THE INVENTION

It is an object of the invention to provide a decisive reduction of the manufacturing costs of a lever-type cam follower made of sheet metal.

This and other objects and advantages of the invention will become obvious from the following detailed description.

SUMMARY OF THE INVENTION

The invention achieves the above objects by the fact of using a cold-working, core-hardening heat-treatable steel.

Due to the transformation hardening over the entire cross-section of the lever-type cam follower, an almost homogeneous hardened zone is obtained that besides having a high strength also possessed good toughness properties. By transformation hardening is not only the strength enhanced but the microstructure is rebuilt and refined. Although, during tempering, the previously achieved increase of strength is partially reversed, the toughness is increased to above the original value. Lever-type cam followers made according to the provisions of the invention can support higher loads without a modification of the cross-section, or can support the same loads with a smaller cross-section. A further advantage of lever-type cam followers of the invention is that, by reason of the different heat treatment, they possess a further saving potential. On the one hand, it is possible to reduce the duration of the heating run and, on the other, the heating temperature. The higher dimensional and shape stability of the lever-type cam followers of the invention is a further advantage.

According to further particularly advantageous features of the invention, the core hardness has a value of ≧600 HV and the surface hardness has a value of ≧680 HV, the core hardness being situated in a range between 600 and 650 HV and the surface hardness in a range between 680 and 700 HV.

Finally, according to another proposition of the invention, the lever-type cam follower is made of a heat-treatable steel of the brand C45M having 0.39-0.46% C, up to 0.15% Si, 0.55-0.70% Mn, up to 0.020% P, up to 0.07% S, 0.25.-0.40% Cr, 0.020-0.060% Al, 0.0040-0.0100% $N_2$. 0.10-0.20% Ni, 0.05-0.10% Mo, up to 0.005% Sn, up to 0.002% Sb, up to 0.15% Cu, total Cu, Ni, Mn, Cr 1.00 to 1.45%.

This cold-forming, core-hardening steel is an isotropic fine grained steel with a high level of purity. Its deep-drawing and shaping capability is comparable with hitherto used cold-rolled strip materials, its hardening ability, however, is distinctly superior to that of conventional steels. Due to its higher core hardness, it can support higher static and dynamic loads than parts made of conventional steels. This reduces plastic deformations at points subjected to high static loading.

The invention will now be described more closely with reference to one example of embodiment illustrated in the appended drawings.

DETAILED DESCRIPTION OF THE DRAWINGS

Figure 1:
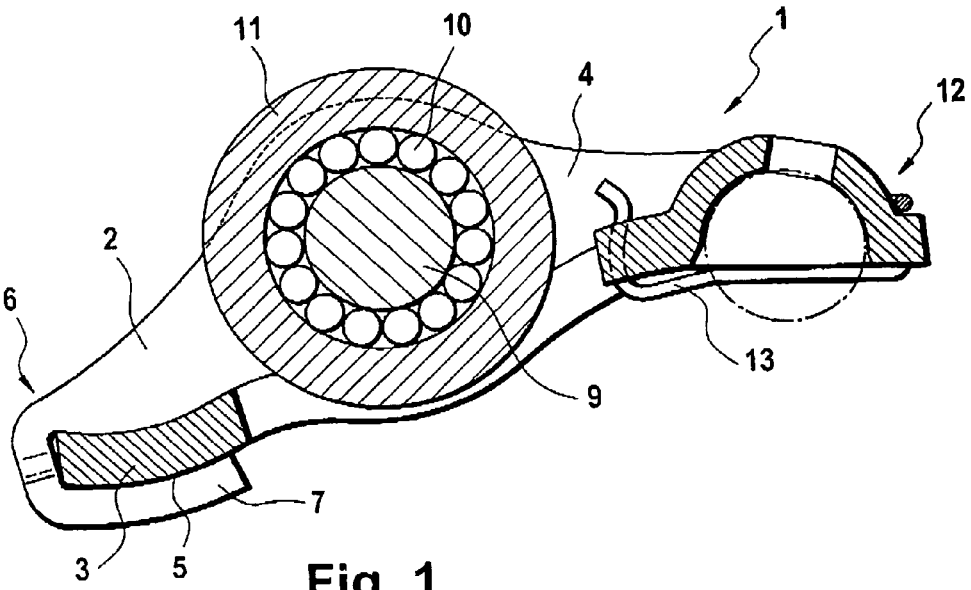
FIG. 1 shows a longitudinal section through a cam follower.
Figure 2:
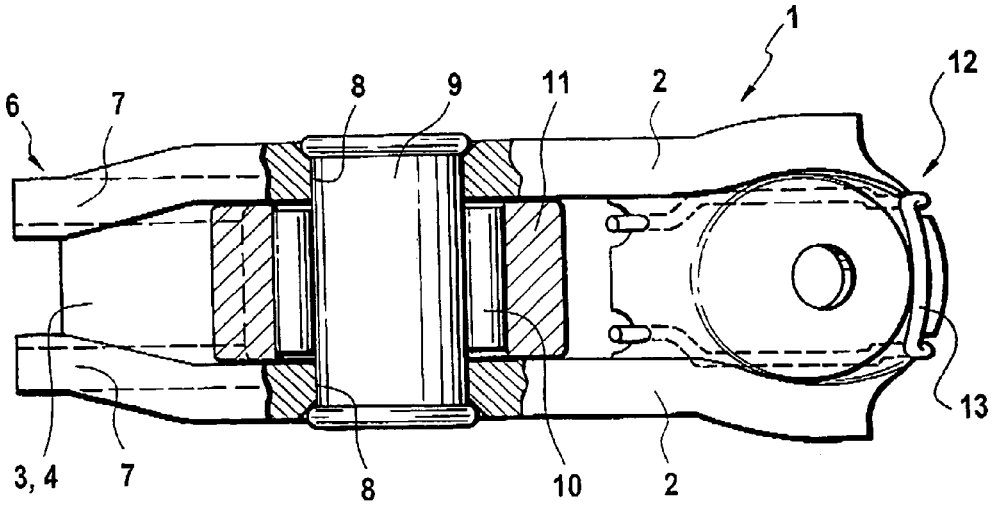
FIG. 2 is a top view of the cam follower of FIG. 1.

FIGS. 1 and 2 show by way of example, a cam follower 1 in the form of a finger lever that is made of a sheet metal and has a finger-like geometry. A crossbar 3 extends between parallel side walls 2 of the finger lever 1 to connect the side walls 2 to each other so that a profile with a U-shaped cross-section is formed that encloses the intermediate space 4. An end of a stem of gas exchange valve, not illustrated, bears against a region of the end 6 on an underside 5 oriented away from the intermediate space 4. The end of the valve stem is mounted between two webs 7 that likewise extend on the underside 5. The side walls 2 possess two aligned holes 8 into which the axle 9 is inserted. The roller 11 is mounted on this axle 9 through the rolling bearing 10. A cam of a camshaft, not illustrated, is operatively connected to the roller 11. In the region of a further end 12, the cam follower 1 is mounted on a head of a support element, not illustrated. The cam follower and the head of the support element are connected to each other by a retaining element 13. The webs 7 are made integrally as extensions of the side walls 2 and are bent through 180° in the region of the end 6 onto the underside 5. At the same time, in the region of the end 6, the width of the cam follower 1 is reduced.

Such a cam follower 1 is made without chip removal from a 3.5 mm thick strip of the heat-treatable steel C45M having the following chemical composition:

0.39-0.46% C, up to 0.15% Si, 0.55-0.70% Mn, up to 0.020% P, up to 0.07% S, 0.25.-0.40% Cr, 0.020-0.060% Al, 0.0040-0.0100% $N_2$. 0.10-0.20% Ni, 0.05-0.10% Mo, up to 0.005% Sn, up to 0.002% Sb, up to 0.15% Cu, total Cu, Ni, Mn, Cr 1.00 to 1.45%.

Figure 3:
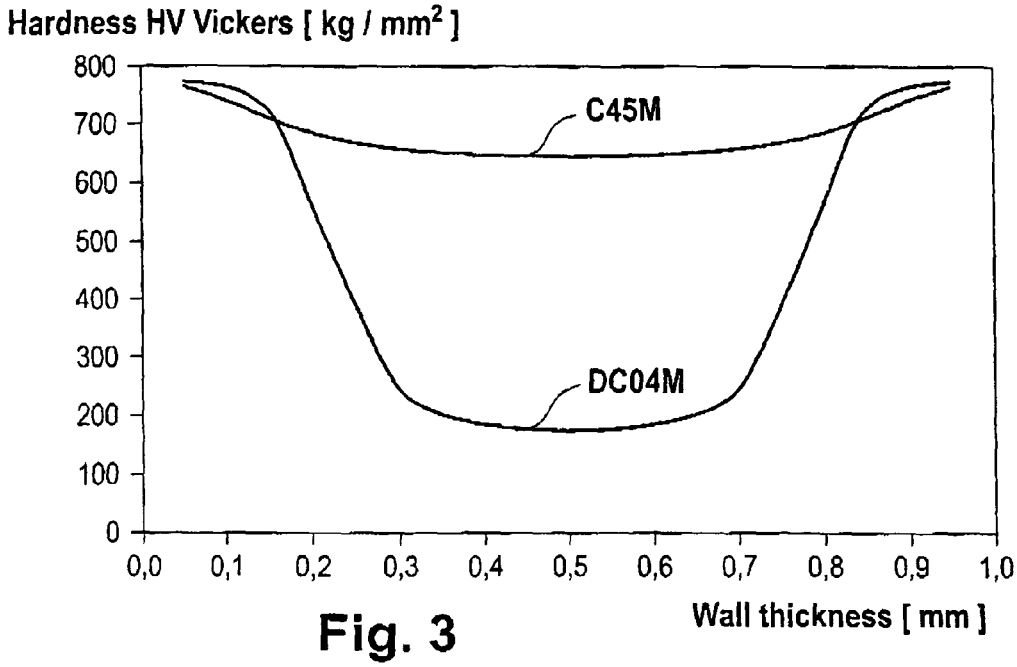
FIG. 3 shows a hardness comparison between a conventional steel and a steel of the invention.

As can be seen from FIG. 3, after heat treatment, the hardness curve of a steel C45M of the invention, in contrast to a conventional steel of the brand DC04M, slopes down only flatly towards the center of the strip. While the surface hardness is about 750 HV, the core hardness reaches a value of about 650 HV. Due to this optimized hardenability, that must be matched to the component geometry and the loading, this steel exhibits high core hardness, toughness and elasticity. In the final analysis, it is this high core hardness of the cold-forming, core-hardening steel that makes possible the aforesaid saving potentials like the reduction of the wall cross-section, increase of strength and reduction of the overall weight.

Figure 4:
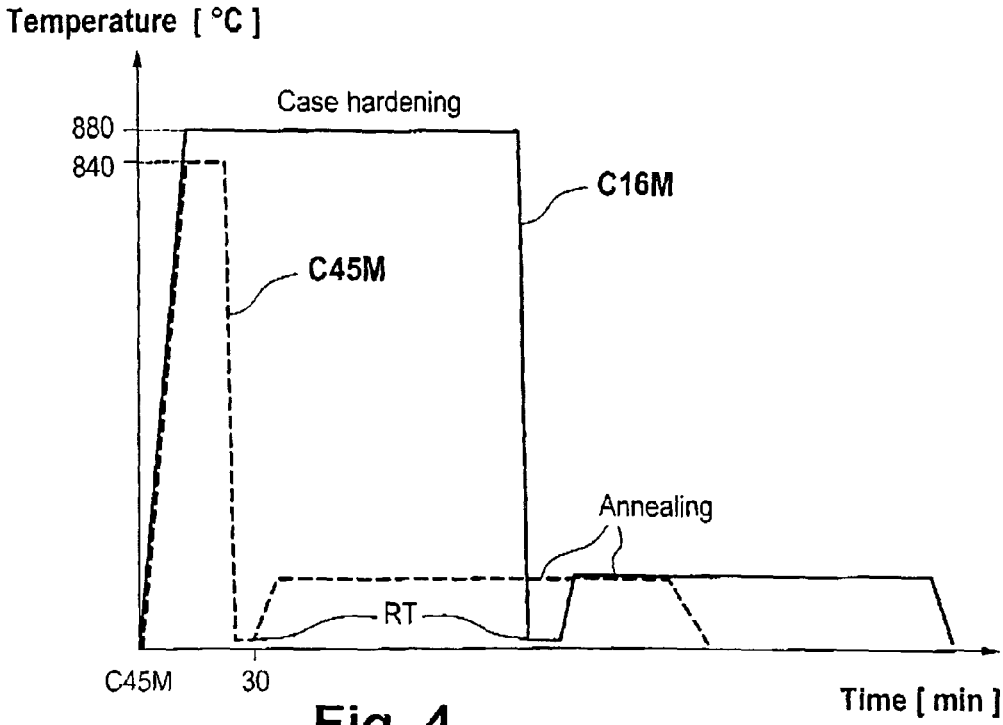
FIG. 4 shows a heat treatment of a conventional steel and the steel of the invention.

According to FIG. 4, a cam follower 1 made of the case-hardening steel C16M is subjected to a conventional case hardening procedure in which the lever 1 is held for 120 min at a temperature of 880° C. Following this, the part is quenched to room temperature and then tempered for 120 min. This is a heat treatment that is intended to impart a high toughness to the material that is in a hardened and relatively brittle state. The procedure consists in heating to temperatures between 160-650° C. with an adequate holding time and cooling again to room temperature. Through the tempering step, the hardness is reduced, the strength decreases and ductility and toughness increase. Thus, by case hardening, a quasi composite material is formed in which the surface has the maximum attainable hardness and the core is substantially softer.

If the same cam follower 1 is made of the heat-treatable steel C45M, it is at first hardened with mild carburization by holding for 30 min at 840° C. This is likewise followed by quenching to room temperature and tempering, in this case too, for a duration of 120 min. It can be clearly seen that in the first case, the actual hardening step in case hardening lasts 120 min and in the second case, only 30 min, so that a time saving of 75% is achieved in the hardening step itself. A further advantage is that it is also possible to harden at a temperature that is lower by 40° C. which means that a substantial amount of energy can be saved. A further advantage, finally, is that a cam follower 1 of the invention made of the steel brand C45M compared to a case-hardened cam follower made of the steel brand C16M exhibits much lower distortion and instability of shape and therefore does not require reworking by machining.

The invention claimed is:

1. A lever cam follower made without chip removal out of a sheet steel for use in a valve train of an internal combustion engine for actuating at least one gas exchange valve, said sheet steel being a cold formable, core-hardening heat-treatable steel, the cam follower having a core hardness of >600 HV and a surface hardness of >680 HV, the steel sheet being a heat-treatable steel of the brand C45M comprising 0.39-0.46% C, up to 0.15% Si, 0.55-0.70% Mn, up to 0.020% P, up to 0.07% S, 0.25-0.40% Cr, 0.020-0.060% Al, 0.0040-0.0100% $N_2$, 0.10-0.20% Ni, 0.05-0.10% Mo, up to 0.005% Sn, up to 0.002% Sb, up to 0.15% Cu, the total of Ni, Mn, Cr equals 1.00 to 1.45% and a balance of Fe and unavoidable impurities.

* * * * *